US006509536B2

(12) United States Patent
Sasaki

(10) Patent No.: US 6,509,536 B2
(45) Date of Patent: Jan. 21, 2003

(54) KEY SWITCH DEVICE

(75) Inventor: Fimitoshi Sasaki, Chofu (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 09/756,387

(22) Filed: Jan. 8, 2001

(65) Prior Publication Data

US 2002/0088698 A1 Jul. 11, 2002

(30) Foreign Application Priority Data

Mar. 30, 2000 (JP) ..... 2000-095669

(51) Int. Cl.[7] ..... H01H 13/70
(52) U.S. Cl. ..... 200/344; 200/5 A
(58) Field of Search ..... 200/344, 517, 200/345, 5 A; 400/490, 491, 491.2, 495, 495.1, 496

(56) References Cited

U.S. PATENT DOCUMENTS 5,823,325 A * 10/1998 Lin ..... 200/344
6,100,482 A * 8/2000 Koma et al. ..... 200/344

FOREIGN PATENT DOCUMENTS

JP 5-234456 * 10/1993

* cited by examiner

*Primary Examiner*—Elvin Enad
*Assistant Examiner*—Lisa N. Klaus
(74) *Attorney, Agent, or Firm*—Fattibene & Fattibene; Paul A. Fattibene; Arthur T. Fattibene

(57) ABSTRACT

A key switch device having an increased strength and a decreased thickness, and produced at a decreased cost yet offering good operation feeling. The key switch device 11 has a key top 13 mounted on a base plate 12 via a rubber spring 16 so as to be freely lifted and lowered, and the switching operation is effected upon depressing the key top 13, wherein a small link member 14 and a large link member 15 are provided between the base plate 12 and the key top 13 so as to turn at right angles without contacting to each other, the lower ends of the small link member 14 are slidably fitted into slide guides 12*a* and 12*b* formed in the base plate 12, the upper ends thereof are supported by bearing portions with slit 13*a* and 13*b* provided at the lower ends of the key top 13, the lower ends and the upper ends of the large link member 15 are supported by the bearing portions with slit 12*c*, 12*d*, 13*c* and 13*d* provided on the base plate 12 and at the lower ends of the key top 13, and the key top 13 is supported by the rubber spring 16, by the small link member 14 and by the large link member 15 so as to be freely lifted and lowered.

7 Claims, 8 Drawing Sheets

KEY SWITCH DEVICE

BACKGROUND OF THE INVENTION

1. Field of the Invention

This invention relates to a key switch device and, particularly, to a key switch device of the link type used for a thin keyboard of a notebook-type personal computer.

2. Prior Art

A conventional key switch device of this type will be described with reference to FIGS. 6 to 8. In FIG. 6(*a*), reference numeral 1 denotes a key switch device that is schematically diagramed. The key switch device 1 is of the so-called pantograph link-type in which two link members 4 and 5 are crossing in an X-shape between a base plate 2 and a key top 3, the key top 3 being supported by a rubber spring (not shown) interposed between the base plate 2 and the key top 3, and by the link members 4 and 5. Referring to FIG. 6(*b*), the link members 4 and 5 have a nearly U-shape, and are fitted together at fitting portions 6 and 7 so as to freely turn. The link member 4 is rotatably supported by shafts at rotary portions 4*a* and 4*b* at its upper both ends thereof by bearing portions 3*a* and 3*b* provided at the lower ends of the key top 3, and slidably engages at slide portions 4*c* and 4*d* at lower both ends thereof with slide guides 2*a* and 2*b* formed in the base plate 2. The other link member 5 slidably engages at slide portions 5*a* and 5*b* at upper both ends thereof with slide guides 3*c* and 3*d* formed in the lower ends of the key top 3, and is rotatably supported by shafts at rotary portions 5*c* and 5*d* at lower both ends thereof by bearing portions 2*c* and 2*d* provided on the substrate 2. The bearings 3*a*, 3*b*, 2*c* and 2*d* are the ones with a slit.

When depressed, the key top 3 is lowered maintaining nearly a horizontal state due to the linking action of the link members 4 and 5, whereby a switching member (not shown) provided on the base plate 2 is depressed to render the switching member conductive.

FIG. 7(*a*) is a diagram illustrating the direction of operation of the key switch device 1. The key top 3 of the key switch device 1 is depressed at a depress angle of about 90 degrees with respect to the surface of the base plate 2.

FIG. 7(*b*) illustrates a state where the key switch device 1 is mounted on a keyboard 8 that is installed being inclined at an angle $\alpha$ with respect to the horizontal plane. When depressed by a finger 9 of a person who operates the keyboard, the key top 3 of the key switch device 1 is lowered at an angle $\alpha$ of inclination that is added to the depress angle of nearly 90 degrees with respect to the horizontal plane. Here, the angle $\alpha$ of inclination is, in practice, a limited angle. Therefore, the direction of depress by the finger 9 of the person operating the keyboard and the direction of depress of the key top 3, differ greatly toward the upper side of the keyboard 8 to deteriorate the feeling of operation.

FIG. 8 illustrates a curved keyboard 10 for a desktop use, which is generally regarded to offer the most desirable operability. In the curved keyboard 10, the upper surfaces of the key tops 3 are arranged being so curved that the angle of inclination increases from the lower side toward the upper side to meet the motion of the finger 9.

The above arrangement of the curved keyboard 10 may be desirable. When the above arrangement cannot be realized, however, the depress directions of the key tops 3 of the key switch device 1 may be so improved as to approach those of the above curved keyboard 10, in order to improve the operation feeling of the key switch device 1.

In the above-mentioned conventional key switch device, the two link members are crossing in an X-shape between the base plate and the key top constituting the so-called pantograph link system, and the key top is supported by the rubber spring and by the two link members.

Therefore, the two link members have fitting portions that fit together in a crossing manner and further have two rotary portions and two slide portions, respectively. That is, the switch device has a total of 10 moving support portions. However, the moving support portions have a small strength. In particular, the portions where the link members are fitted together have a small strength, hindering the effort for realizing the key switch device in a reduced thickness.

Further, the slide portions of the key top of the key switch device are injection-molded using a metal mold of a complex shape, the metal mold being manufactured requiring an increased cost.

Besides, the key top is supported at four points at the lower ends thereof by using the link members, two points among the four points being supported by slide portions. Accordingly, the surface of the key top tends to be tilted to develop play; i.e., the surface of the key top is not maintained in a horizontal state.

Moreover, the key top is depressed at an angle of nearly 90 degrees with respect to the surface of the base plate, which is greatly different from the direction of depress by a finger of the operator, deteriorating the operation feeling. Thus, there arouses a technical problem that must be solved for realizing a key switch device that features an increased strength, a decreased thickness yet being produced at a decreased cost and offering a favorable operation feeling. The object of this invention is to solve this problem.

SUMMARY OF THE INVENTION

This invention was proposed in order to achieve the above object, and provides a key switch device in which a key top is mounted on a base plate via a rubber spring so as to be freely lifted and lowered, and the switching operation is effected upon depressing the key top, wherein a small link member and a large link member are provided between the base plate and the key top so as to turn at right angles without contacting to each other, the lower ends of the small link member are slidably fitted into slide guides formed in the base plate, the upper ends thereof are supported by bearing portions with slit provided at the lower ends of the key top, the lower ends and the upper ends of the large link member are supported by the bearing portions with slit provided on the base plate and at the lower ends of the key top, and the key top is supported by the rubber spring, by the small link member and by the large link member so as to be freely lifted and lowered.

DESCRIPTION OF THE PREFERRED EMBODIMENT

Figure 1A:
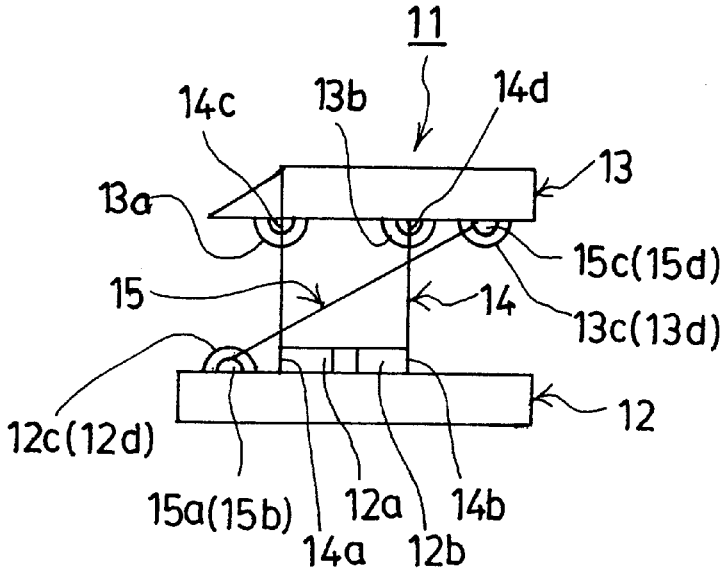
FIG. 1 is a view illustrating an embodiment of this invention, wherein FIG. 1(*a*) is a front view schematically illustrating a key switch device, and FIG. 1(*b*) is a perspective view schematically illustrating a small link member and a large link member.
Figure 1B:
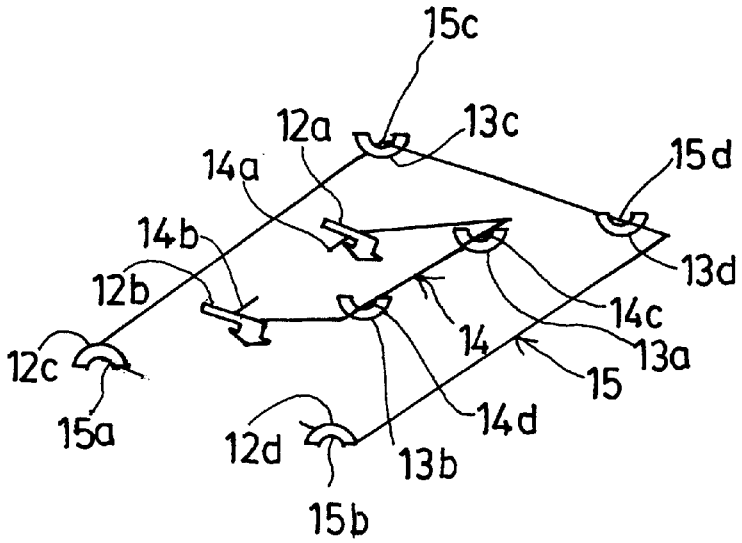

An embodiment of the invention will now be described in detail with reference to FIGS. 1 to 5. In FIGS. 1(*a*) and 1(*b*), reference numeral 11 denotes a key switch device that is schematically diagramed. The key switch device 11 is provided with a small link member 14 and a large link member 15 that turn at right angles without coming in contact with each other between a base plate 12 and a key top 13 provided over the base plate 12. Slide portions 14*a* and 14*b* provided at lower both ends of the small link member 14 slidably engage with slide guides 12*a* and 12*b* formed in the base plate 12, and rotary portions 14*c* and 14*d* provided at upper both ends thereof are rotatably fitted to bearing portions with slit 13*a* and 13*b* provided at the lower ends of the key top 13. Further, rotary portions 15*a* and 15*b* at lower both ends of the large link member 15 are rotatably fitted to bearing portions with slit 12*c* and 12*d* provided on the base plate 12, and rotary portions 15*c* and 15*d* at upper both ends thereof are rotatably fitted to bearing portions with slit 13*c* and 13*d* provided at the lower ends of the key top 13.

Figure 2:
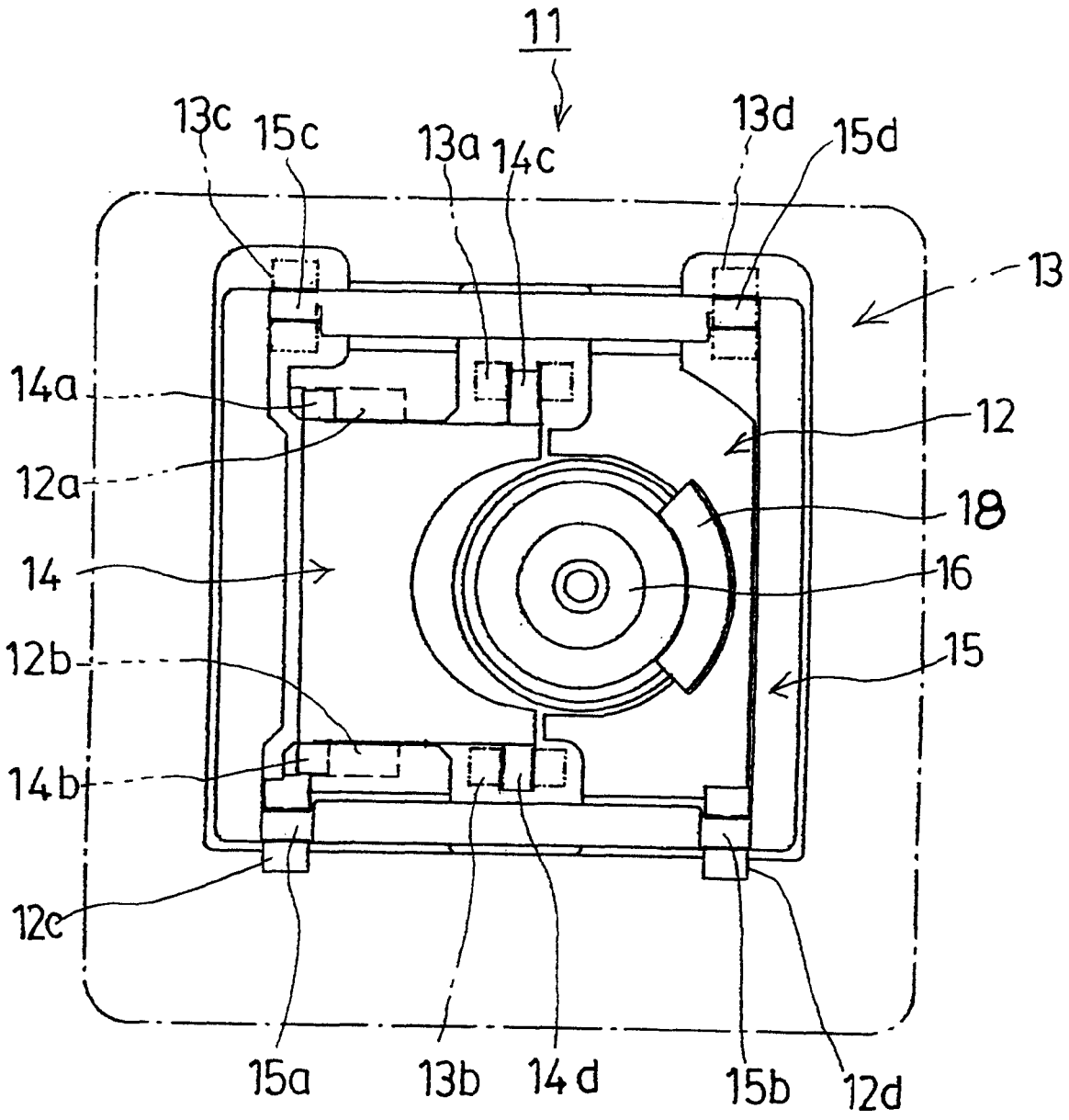
FIG. 2 is a plan view of a key switch device from which a key top is removed according to the embodiment of the invention.

FIG. 2 is a plan view illustrating a state where the key top 13 is removed from the key switch device 11. A rubber spring 16 of nearly a dome shape is interposed nearly at the central portion of the key switch device 11, the rubber spring 16 being placed on the base plate 12 and urging the key top 13 placed on the rubber spring 16 upward. The small link member 14 is cut away at its upper central portion in an arcuate shape to meet the shape of the rubber spring 16 so will not to interfere with the rubber spring 16. In FIG. 2, reference numeral 18 denotes a fixing member for fixing the rubber spring 16 on the base plate 12.

Figure 3A:
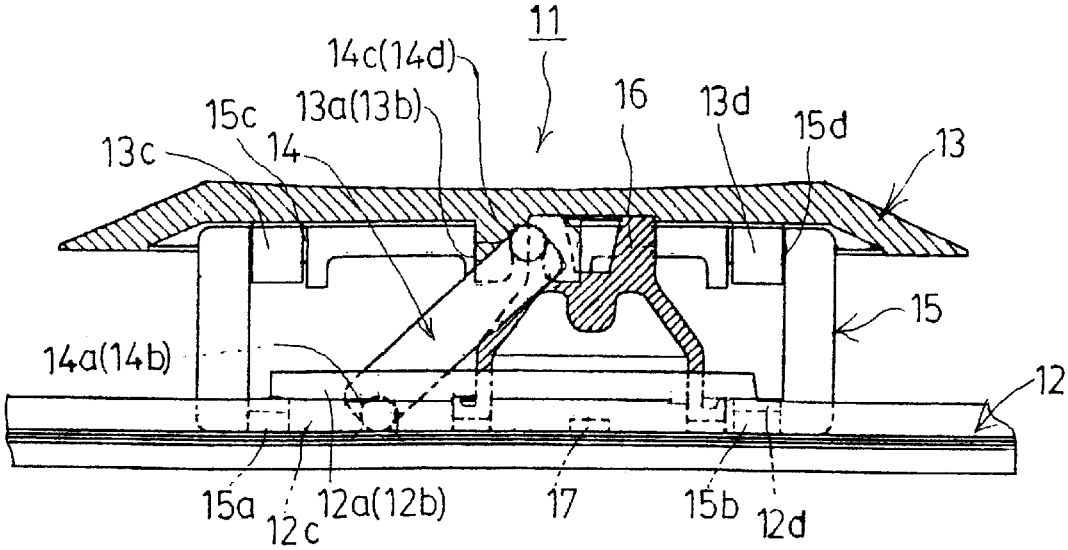
FIG. 3 is a view illustrating the embodiment of this invention, wherein FIG. 3(*a*) is a partly cut-away front view of the key switch device, and FIG. 3(*b*) is a partly cut-away front view of the key switch device in a state where the key top is depressed.
Figure 3B:
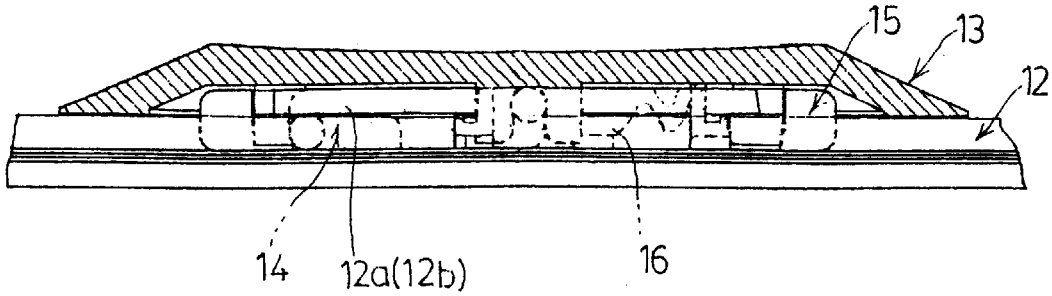

FIG. 3(*a*) is a partly cut-away front view of the key switch device 11 and illustrates a state of before the key top 13 is depressed, and wherein the rubber spring 16 urges the key top 13 upward and, whereby, the small link member 14 and the large link member 15 are raised maintaining predetermined angles relative to the base plate 12.

When the operator depresses the key top 13 in this state, the key top 13 depresses the rubber spring 16 so as to be deformed and, at the same time, the small link member 14 and the large link member 15 are pushed down. At this moment, the rotary portions 14*a* and 14*b* at lower both ends of the small link member 14 slide in the slide guides 12*a* and 12*b* formed in the base plate 12, and the rotary portions 14*c* and 14*d* at upper both ends thereof turn in the bearing portions with slit 13*a* and 13*b* provided at the lower ends of the key top 13. The rotary portions 15*a* and 15*b* at lower both ends of the large link member 15 turn in the bearing portions with slit 12*c* and 12*d* provided on the base plate 12, and the rotary portions 15*c* and 15*d* provided at upper both ends thereof turn in the bearing portions with slit 13*c* and 13*d* provided at the lower ends of the key top 13.

Owing to the linking action of the small link member 14 and the large link member 15, therefore, the key top 13 is depressed nearly in parallel with the base plate 12. When depressed down to a predetermined position, the rubber spring 16 depresses a switching member 17 provided on the base plate 12 so as to be conductive. Further, when the key top 13 is depressed down to the lowermost point, the key top 13 comes into contact with the base plate 12 as shown in FIG. 3(*b*) and is depressed no more. The direction of depressing the key top 13 in FIGS. 3(*a*) and 3(*b*) is nearly at right angles with the surface of the base plate 12.

Figure 4A:
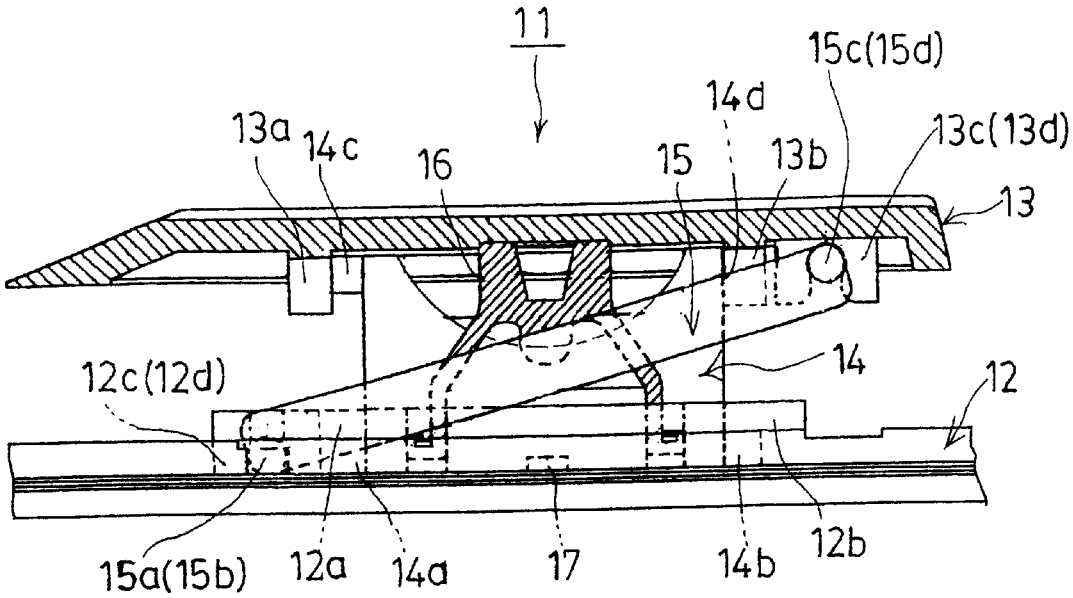
FIG. 4 is a view illustrating the embodiment of this invention, wherein FIG. 4(*a*) is a partly cut-away side view of the key switch device, and FIG. 4(*b*) is a partly cut-away side view of the key switch device in a state where the key top is depressed.
Figure 4B:
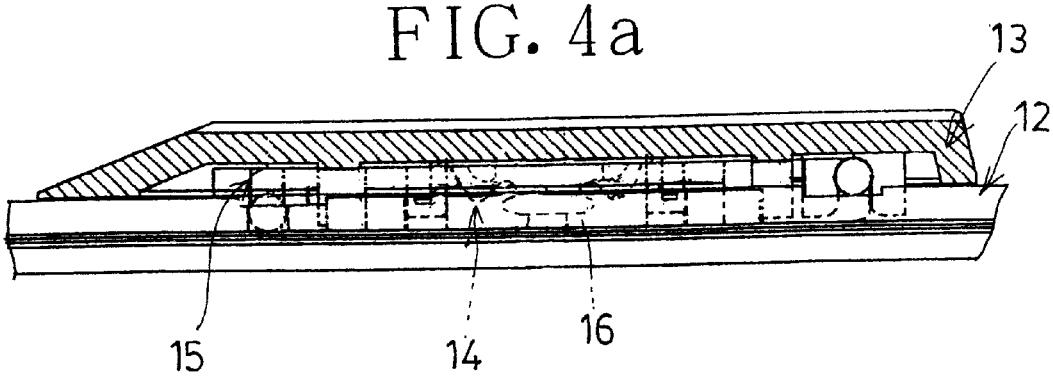
Figure 5A:
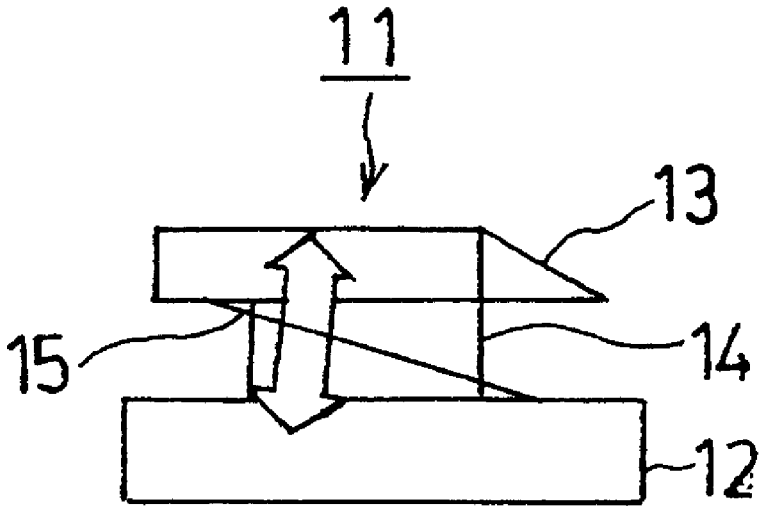
FIG. 5 is a view illustrating the embodiment of this invention, wherein FIG. 5(*a*) is a view schematically illustrating the direction in which the key top is depressed, and FIG. 5(*b*) is a view schematically illustrating the direction in which the key top is depressed being mounted on a keyboard.
Figure 5B:
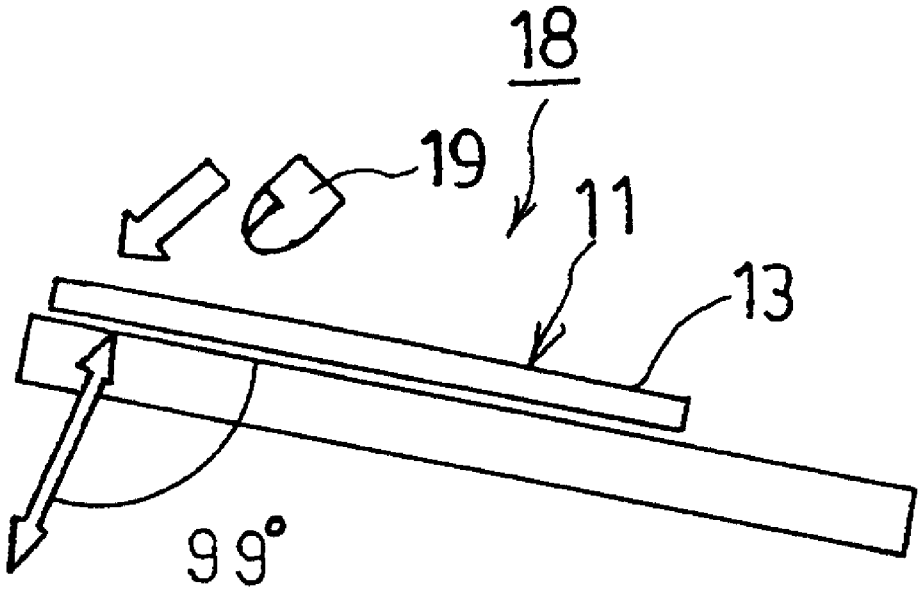

FIG. 4(*a*) is a partly cut-away side view of the key switch device 11. The key top 13 of the key switch device 11 that is depressed down to the lowermost point as shown in FIG. 4(*b*), comes into a halt. Here, the key top 13 comes into a halt while moving toward the right accompanying the turn of the large link member 15. This state will be described with reference to FIG. 5(*a*). The key top 13 is depressed at an angle in excess of 90 degrees with respect to the surface of the substrate 12 as indicated by an arrow. According to experiment, the angle was 99 degrees. FIG. 5(*b*) illustrates an example in which the key switch device 11 is mounted on a keyboard 18. Being depressed by a finger 19, the key top 13 is depressed in a direction of the depress angle (e.g., 99 degrees) to which is added the angle of inclination of the keyboard 18 with respect to the horizontal plane.

Figure 8:
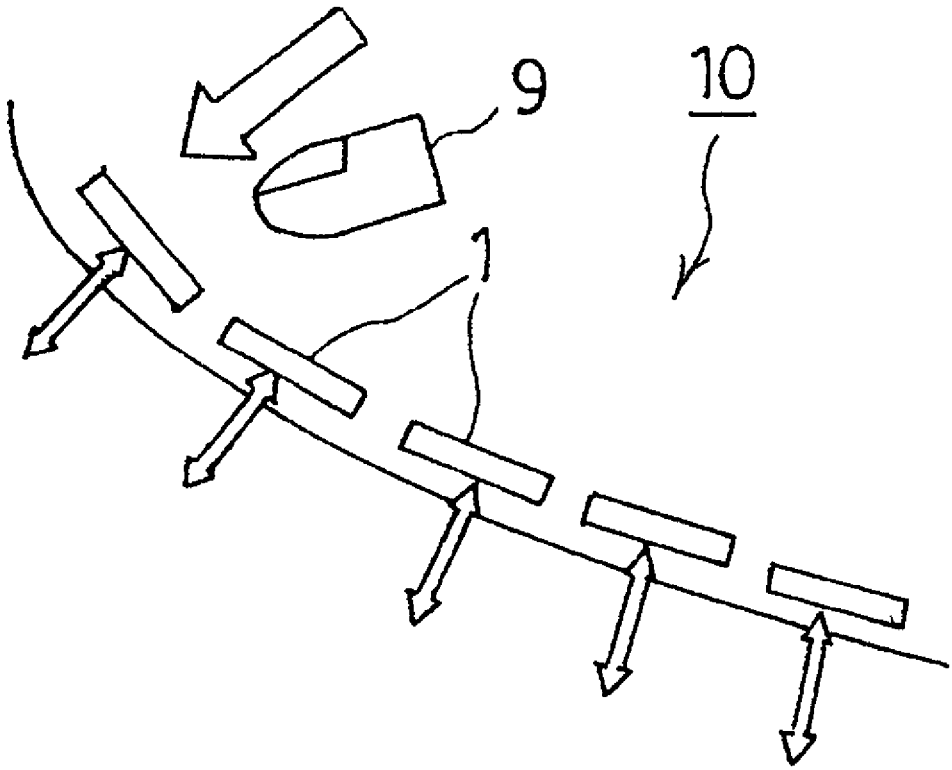
FIG. 8 (Prior Art)
FIG. 8 is a view schematically illustrating a curved keyboard for desktop use which is regarded to offer good operability.

This angle approaches the angle of the above-mentioned curved keyboard (10 in FIG. 8) for the desktop use that offers good operability and, hence, enhances the operability.

Figure 6A:
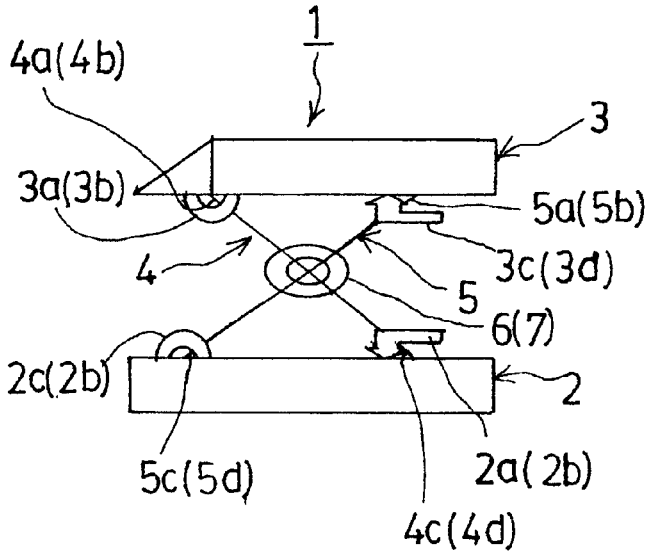
FIG. 6a (Prior Art)
FIG. 6 is a view illustrating a prior art, wherein FIG. 6(*a*) is a front view schematically illustrating the key switch device, and FIG. 6(*b*) is a perspective view schematically illustrating the link members.
Figure 6B:
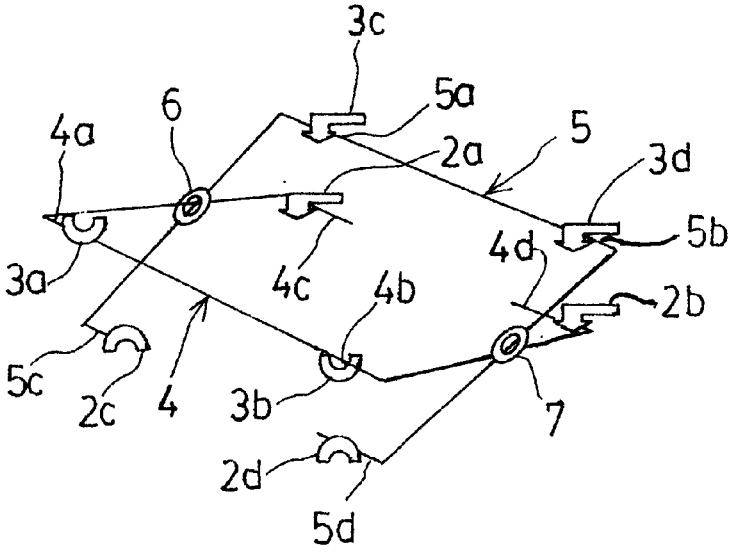
FIG. 6b (Prior Art)
Figure 7A:
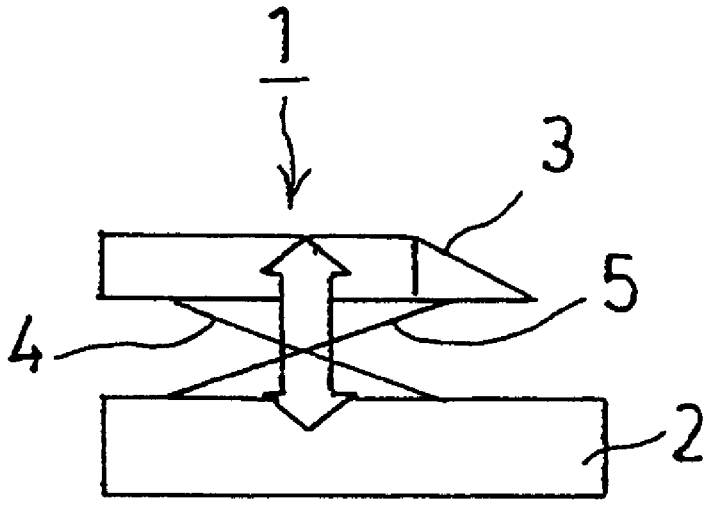
FIG. 7a (Prior Art)
FIG. 7 is a view illustrating the prior art, wherein FIG. 7(*a*) is a view schematically illustrating the direction in which the key top is depressed, and FIG. 7(*b*) is a view schematically illustrating the direction in which the key top is depressed being mounted on the keyboard.
Figure 7B:
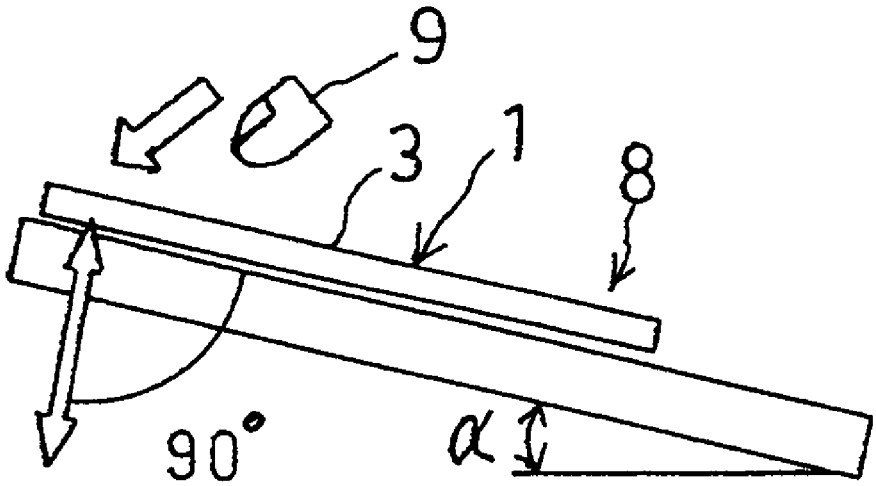
FIG. 7b (Prior Art)

As shown in FIG. 4(*a*), further, the key switch device 11 has eight moving support portions including slide portions 14*a*, 14*b*, and rotary portions 14*c*, 14*d*, 15*a*, 15*b*, 15*c* and 15*d*, which are smaller than ten moving support portions of the conventional key switch device (1 in FIG. 6), and is capable of enhancing the strength. The strength can be further enhanced since there are no fitting portions (6 and 7 in FIG. 6) employed by the prior art. This makes it possible to decrease the thickness of the key switch device 11.

Besides, there is no slide guide in the lower ends of the key top 13, but the bearing portions with slit 13*a*, 13*b*, 13*c* and 13*d* only are provided. Therefore, the key top 13 is easily molded, and the key switch device 11 can be easily fabricated.

The invention can be modified in a variety of ways without departing the spirit of the invention, and it should be noted that the invention encompasses the modified examples, as a matter of course.

As described above in detail by way of an embodiment, this invention is concerned with a key switch device in which a key top is mounted on a base plate via a rubber spring so as to be freely lifted and lowered, wherein a small link member and a large link member are provided between the base plate and the key top so as to turn at right angles without contacting to each other, the lower ends of the small link member are slidably fitted into slide guides formed in the base plate, the upper ends thereof are supported by bearing portions with slit provided at the lower ends of the key top, and the lower ends and the upper ends of the large link member are supported by the bearing portions with slit provided on the base plate and at the lower ends of the key top. Therefore, the key top is supported by the rubber spring, by the small link member and by the large link member so as to be freely lifted and lowered.

The key switch device has moving support portions in a number smaller than those of the prior art and does not employ the fitting portions for fitting the link members that are mechanically liable to decrease the strength. Accordingly, the key switch device enhances the strength and decreases its thickness.

Further, since the key top has no slide guide portion, the surface of the key top is favorably maintained in a horizontal state without developing play. Besides, the key top is molded by using a metal mold which is easily fabricated contributing to decreasing the cost.

Moreover, the key top is depressed at an angle in excess of 90 degrees with respect to the surface of the base plate, and offers better operation feeling than that of the prior art.

Thus, the invention provides a key switch device having an increased strength and a decreased thickness at a decreased cost, yet offering good operation feeling, which are distinguished effects of the invention.

What is claimed is:

1. A key switch device in which a key top is mounted on a base plate via a rubber spring so as to be freely lifted and lowered, and a switching operation is effected upon depressing the key top, wherein a single piece U-shaped small link member and a single piece U-shaped large link member are provided between the base plate and the key top so as to turn at right angles without contacting each other and the single piece U-shaped large link member is entirely contained within a perimeter of the large link member and forms a single movable plane, lower ends of the small link member are slidably fitted into slide guides formed in the base plate, upper ends thereof are supported by small link bearing portions with a slit provided at lower ends of the key top, lower ends and upper ends of the single piece U-shaped large link member are supported by large link bearing portions with slit provided on the base plate and at the lower ends of the key top, and the key top is supported by the rubber spring, by the single piece U-shaped small link member and by the single piece U-shaped large link member so as to be freely lifted and lowered.

2. A key switch for a keyboard comprising:

a base plate;

a key top;

a single piece U-shaped large link member having a perimeter and placed between said base plate and said key top and rotatable about a first axis; and a single piece U-shaped small link member placed entirely within the perimeter of said single piece U-shaped large link member and rotatable about a second axis forming a single movable plane, the second axis being at right angles with the first axis, whereby said key top is favorably maintained in a horizontal state without developing play.

3. A key switch as in claim 2 wherein:

said key top moves at an angle in excess of ninety degrees with respect to said base plate.

4. A key switch as in claim 3 wherein:

the angle is ninety-nine degrees.

5. A key switch as in claim 2 further comprising:

a rubber spring placed between said key top and said base plate.

6. A key switch as in claim 2 wherein:

said key is a quadrilateral.

7. A key switch for a keyboard comprising:

a base plate;

a switch member formed on said base plate;

a slide guide pair formed within said base plate;

a slit pair formed on said base plate;

a square key top;

a rubber spring positioned over said switch member and placed between said base plate and said square key top;

a first slit pair formed on said square key top;

a second slit pair formed on said square key top;

a single piece U-shaped large link member having a perimeter and placed between said base plate and said key top and rotatable about a first axis, said single piece U-shaped large member having a first rotary portion placed within said first slit pair formed on said square key top and a second rotary portion placed within said slit pair formed on said base plate; and a single piece U-shaped small link member placed entirely within the perimeter of said large link member and rotatable about a second axis forming a single movable plane, the second axis being at right angles with the first axis, said single piece U-shaped small link member having a slide portion placed within said slide guide pair formed within said base plate and a third rotary portion placed within said second slit pair formed on said square key top, whereby said key top is favorably maintained in a horizontal state without developing play.

* * * * *